United States Patent [19]

Ehrlichmann

[11] Patent Number: 4,515,089

[45] Date of Patent: May 7, 1985

[54] INCINERATOR HAVING KINETIC VENTURI ISOTHERMIC GRID BURNER SYSTEM

[75] Inventor: Merlin W. Ehrlichmann, Alexandria, Minn.

[73] Assignee: Sunburst Laboratories, Inc., Minneapolis, Minn.

[21] Appl. No.: 583,046

[22] Filed: Feb. 23, 1984

[51] Int. Cl.[3] ..... F23B 5/00

[52] U.S. Cl. ..... 110/235; 110/212; 110/213; 110/214

[58] Field of Search ..... 110/212, 213, 214, 235, 110/236

[56] References Cited

U.S. PATENT DOCUMENTS

| | | | |
|---|---|---|---|
| 3,087,443 | 4/1963 | Attanasio et al. | 110/18 |
| 3,224,842 | 12/1965 | Manske | 23/277 |
| 3,560,165 | 2/1971 | Beasley | 110/212 X |
| 3,615,249 | 10/1971 | Martois | 23/277 C |
| 3,658,482 | 4/1972 | Evans et al. | 23/277 C |
| 3,680,500 | 8/1972 | Pryor | 110/8 A |
| 3,716,001 | 2/1973 | Potasek et al. | 110/212 X |
| 3,749,032 | 7/1973 | Ehrlichmann | 110/8 A |
| 3,786,767 | 1/1974 | Schwartz, Jr. et al. | 110/8 A |
| 3,792,671 | 2/1974 | Woods | 110/8 R |
| 3,808,987 | 5/1974 | Ehrlichmann | 110/8 A |
| 3,867,102 | 2/1975 | Casathy | 23/277 C |
| 3,880,594 | 4/1975 | Shaw | 23/277 C |
| 3,881,870 | 5/1975 | Hatfield | 23/277 |
| 3,885,919 | 5/1975 | Pillard | 23/277 C |
| 4,032,361 | 6/1977 | Eriksson et al. | 110/212 X |
| 4,145,979 | 3/1979 | Lilley et al. | 110/210 |
| 4,156,393 | 5/1979 | Mallek | 110/208 |
| 4,193,354 | 3/1980 | Woods | 110/212 |
| 4,317,417 | 3/1982 | Foresto | 110/211 |

*Primary Examiner*—Edward G. Favors

*Attorney, Agent, or Firm*—Kinney & Lange

[57] ABSTRACT

An incinerator system includes a main burner chamber and an afterburner or recirculating burner chamber which forms a kinetic venturi action to insure intermixing of burning gases for substantially complete combustion. The gaseous effluents from the main burner are caused to be rotated in a vortex or tornadic action along a substantial right circular cylinder secondary burner chamber while a burner utilizing external fuel directs flame in the center of the tornadic flow as the effluents and burning gases move from one end of the secondary burner chamber to the other. A portion of the hot gases is recirculated into the main burner chamber. The effluents from the main burner chamber, where waste materials such as garbage or similar organic materials are combusted, is directed at relatively high velocity in a spiralling action around the secondary chamber and to cause turbulation, intermixing of the air carrying the effluents or pollutants with a burner flame, and to insure that adequate combustion is taking place. Suitable burner controls are used for regulating the burner operations.

10 Claims, 3 Drawing Figures

INCINERATOR HAVING KINETIC VENTURI ISOTHERMIC GRID BURNER SYSTEM

BACKGROUND OF THE INVENTION

1. Field of the Invention

The present invention relates to waste material incinerators utilizing a main burner chamber and afterburner chamber which provides for a substantially increased turbulence, a long burning path, and very efficient operation.

2. Description of the Prior Art

In the prior art many incinerators for burning waste materials have been advanced for burning garbage or trash, and also such incinerators have included main burners and afterburner assemblies.

For example, U.S. Pat. No. 3,792,671, issued to Woods on Feb. 19, 1974, shows an incinerator with an afterburner, using a substantially different principle from the present device, but does burn trash. The device includes burner controls including a temperature sensor controlling the air-fuel ratio to utilize excess air to maintain a constant temperature in the afterburner to effect complete combustion. The present device also uses a temperature sensor in the afterburner for maintaining a preset temperature in such afterburner to insure complete combustion.

Another type of afterburner is shown in U.S. Pat. No. 3,749,032, issued to Ehrlichmann on July 31, 1973, which has an effluent discharge pipe, and a central burner. The smoke and air are introduced at right angles to the axis of the burner, and in this device the size of the combustion chamber may be adjusted by a baffle plate on the interior of the burner.

U.S. Pat. No. 3,808,987, issued to Ehrlichmann on May 7, 1974 shows an afterburner construction wherein effluents are introduced through an opening in the side of the afterburner, and baffles are utilized for directing airflow in a desired manner.

Specifically, as shown in FIGS. 4, 5, 6 and 7 of the patent, a burner construction is shown wherein the air for the burner is supplied concentrically with and around the main gas supply for mixing the air.

Various baffling devices for intermixing smoke or effluent gases with air or with flame from a burner have been advanced. For example, U.S. Pat. No. 3,560,165, issued to Beasley on Feb. 2, 1971, illustrates a flue smoke incinerator which has a series of baffles for directing the air in different directions as it flows.

U.S. Pat. No. 3,087,443, issued to Attanasio et al. on Apr. 30, 1963, illustrates a smoke eradicator for a trash burner building, which has auxiliary burners for intermixing flame with the smoke, and includes mesh paddles for part of the air mixing or turbulation process.

An effluent control apparatus is shown in U.S. Pat. No. 3,881,870, issued to Hatfield on May 6, 1975. The device includes an interior burner construction having baffles for directing air in a particular manner to obtain satisfactory removal of smoke issuing from an incinerator.

U.S. Pat. No. 4,317,417, issued to Foresto on Mar. 2, 1982, shows an incinerator apparatus for cleaning waste gases, and includes a scrubber that operates at high temperatures as the effluent flows through.

U.S. Pat. No. 4,193,354, issued to Woods, on March 18, 1980, shows a solid waste disposal system that is a large scale plant and describes a fairly complicated path of flow through a unit.

U.S. Pat. No. 4,156,393, issued to Mallek et al. on May 29, 1979, shows an afterburner and incinerator, with a pair of grates or "sluice gates" that can be controlled for operation.

An afterburner is also shown in U.S. Pat. No. 3,658,482, issued to Evans et al. on Apr. 25, 1972, which defines an annular burner chamber having a wall forming this chamber, and the incompletely burned gases are burned more completely in the annular chamber.

Additional patents which illustrate the state of the art, and show various constructions for baffling and burner shapes are shown in the following U.S. Patents.

| U.S. Pat. No. | Patentee | Issue Date |
|---|---|---|
| 3,224,842 | Manske | 12/21/65 |
| 3,615,249 | Martois | 10/26/71 |
| 3,680,500 | Pryor | 8/1/72 |
| 3,786,767 | Schwartz, Jr. et al. | 1/22/74 |
| 3,867,102 | Csathy | 2/18/75 |
| 3,880,594 | Shaw | 4/29/75 |
| 3,885,919 | Pillard | 5/27/75 |
| 4,145,979 | Lilley et al. | 3/27/79 |

SUMMARY OF THE INVENTION

The present invention relates to an incinerator assembly for burning waste materials such as garbage or other organic materials without discharging pollutants into the air. A main incinerator housing comprises a main burner chamber in which the material to be burned is placed in a normal manner. This chamber is not open directly to the atmosphere, but has an outlet pipe at one end (opposite the main opening door) that leads to the inlet side of a suitable centrifugal blower which has its outlet connected to a cylindrical second burner chamber that is elongated in length and has a generally circular cross section.

The second burner chamber is selected in size and length to insure that the effluent gases that are drawn from the main or lower chamber will adequately mix with the burning or heated gases from a separate gas burner mounted at one end of the second burner chamber. The outlet of the centrifugal blower is formed to have a sloping output wall on the top to turbulently direct air into the cylindrical second burner chamber. The axis of output flow from the burner is positioned at right angles to the longitudinal axis of the burner, and the opening from the blower has a lower edge above the axis of the cylindrical burner so that as the effluent gases are blown into the second burner chamber by the blower, part of the flow is directed at an angle across the chamber and part laterally across the chamber to create substantial turbulence. The gases will create a wall or layer of swirling air that moves with the burner leading into the chamber and spirals around the outer surface of the burner chamber. The gas burner, in the form shown, discharges burning gas into the central core of the chamber at a desired rate. The effluent gases from the first chamber and blower, and the burning gases from the burner in the second chamber then turbulate and mix thoroughly so that the effluent particles are burned as the effluent gases and the burner gases move down the second chamber formed in the second housing.

The main burner chamber has an air inlet opening leading from the remote end (opposite from the inlet from the blower and burner) of the second burner chamber. The negative pressure created in the main burner chamber by the effluent gas blower and the positive pressure in the second burner chamber cause a portion of the hot gases of combustion from the second chamber to be recirculated into the main burner chamber to heat up the waste material and cause combustion of the mass of material to be burned. Additionally, a discharge pipe is connected to the remote end of the second burner for discharge of clean gases that have been completely combusted in the second burner.

The gas burner in the second chamber is controlled by a modulating gas control, including a temperature sensor mounted adjacent the remote end of the second burner chamber to complete the control cycle and insure that the temperature in the top burner chamber is maintained at a desired level that will cause complete combustion of the effluents coming from the lower chamber. The exact temperature set will vary with the type of material being burner.

The inlet side of the effluent gas blower has a pipe connected to the main burner chamber with a damper in the pipe that is controlled in response to a temperature sensor in the pipe itself to cause the damper to control the out flow of effluent gases from the main chamber as a function of the temperature of the effluent gas pipe leading to the effluent gas blower.

The combination of the tornadic swirling around the circular chamber into which the gas burner introduces burning gases, designed with the appropriate length chamber for insuring adequate mixing and burning of the effluents in the second burner chamber, provides a highly efficient, easily used and controlled, and relatively low cost assembly for pollution control burners and devices.

BRIEF DESCRIPTION OF THE DRAWINGS

FIG. 1 is a part schematic vertical sectional view of an incinerator made according to the present invention;

DETAILED DESCRIPTION OF THE PREFERRED EMBODIMENT

Figure 3:
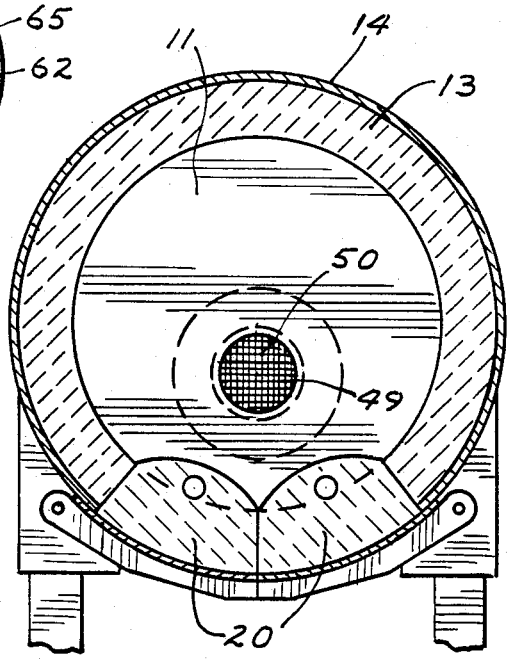
FIG. 3 is a sectional view taken as on line 3—3 in FIG. 1.

In FIG. 1, an incinerator assembly indicated generally at 10, and made according to the present invention, includes a main burner chamber shown at 11, defined on the interior of a main burner housing 12. The housing 12 is lined with fire brick shown at 13, on the inside of a steel jacket 14. The main burner chamber 11 is of a selected length, and has a charging door 15 of a suitable design at one end thereof that opens through a provided opening to the chamber 11. Additionally, as shown in FIG. 3 for example, hinged trap doors 20 may be provided at the bottom side of the housing to permit ashes and unburnable materials that are to be discharged after burning to be removed conveniently on a suitable conveyor.

Automatic loading equipment for loading materials to be burned may be used. For example, the organic materials indicated generally at 21 on the interior of the chamber 11, resting upon the upper surfaces of the doors 20, may be loaded in with mechanical loading equipment, conveyors, or could even be hand loaded. Many of the materials that are burned are things such as industrial garbage, paper waste, tires, and other similar materials.

The incinerator 10 further includes a second burner assembly 25, also called a "afterburner" that is mounted directly above, overlying, and substantial coextensive with the lower burner housing 12. Suitable supports 26 can be used for supporting one end of the second burner housing 25, and at the end adjacent the charging door for the main burner chamber 11, a support and connection pipe 27 may be used to support the upper burner housing 25. As will be explained this connecting pipe 27 provides an inlet to the lower burner chamber 11.

The upper or second burner chamber 25 has an outer jacket 30, a fire brick lining as shown at 31, and has a circular cross section, elongated cylindrical second burner chamber indicated at 32. At what will be called the inlet end of the chamber 32, and defined in the housing 30 is a burner inlet neck 33 that has a central passageway 34 of smaller diameter than the second burner chamber 32, but coaxial therewith. This housing 33 is used for mounting a gas burner 35 of conventional design that is connected to a source fuel, preferably natural gas indicated generally at 36. The burner also has suitable ignitors 37 connected thereto. The burner 35 in turn has a combustion air inlet pipe 38 connected to receive combustion air from a burner blower 40. The burner blower 40 is driven with a suitable motor 41. Generaly speaking the blower 41 will deliver a set amount of air, and the heat from the burner 35 will be controlled by modulating the gas from the gas source 36. Conventional gas modulating controls for the burner 35 are shown in circuit at 44, and they are controlled as will be explained by a temperature sensor and sender unit 45 located adjacent the remote end of the second chamber 32.

It should be noted that if a pilot light is used for the burner 35, the blower air from the blower 40 cannot come on to blow out the pilot light, but other than that substantially constant volume of air from the blower 40 is used. The temperature in the secondary chamber can be controlled to any desired level, but in general the temperature sensed by the sensor 41 at the distal end of the chamber 32 will be in the range of 1500° F. for burning items such as tires, or waste having a combustion temperature similar to tires, and burning of garbage would require a slightly lower temperature than that.

The secondary burner housing has an outlet smoke pipe or hot gas discharge pipe extending uprightly shown at 46 at the remote end of chamber 32.

Additionally, the second burner chamber 32 has a connecting passageway indicated at 47 in the pipe 27, which leads into the main burner chamber 11 at the upper side thereof adjacent the charging door 15.

The main burner chamber 11 has an effluent gas outlet opening or passageway shown at 50 at the end opposite from the charging door 15. This opening 50 has a mesh screen cover 49 which tends to break up smoke and mix the effluent gases. The opening 50 opens through screen cover 49 to a effluent gas transfer pipe or conduit 51, which extends uprightly as shown and is connected to the inlet port or opening shown at 52 (see FIG. 2) of an effluent gas blower 53 that is mounted in a suitable manner relative to the housing 30.

Figure 2:
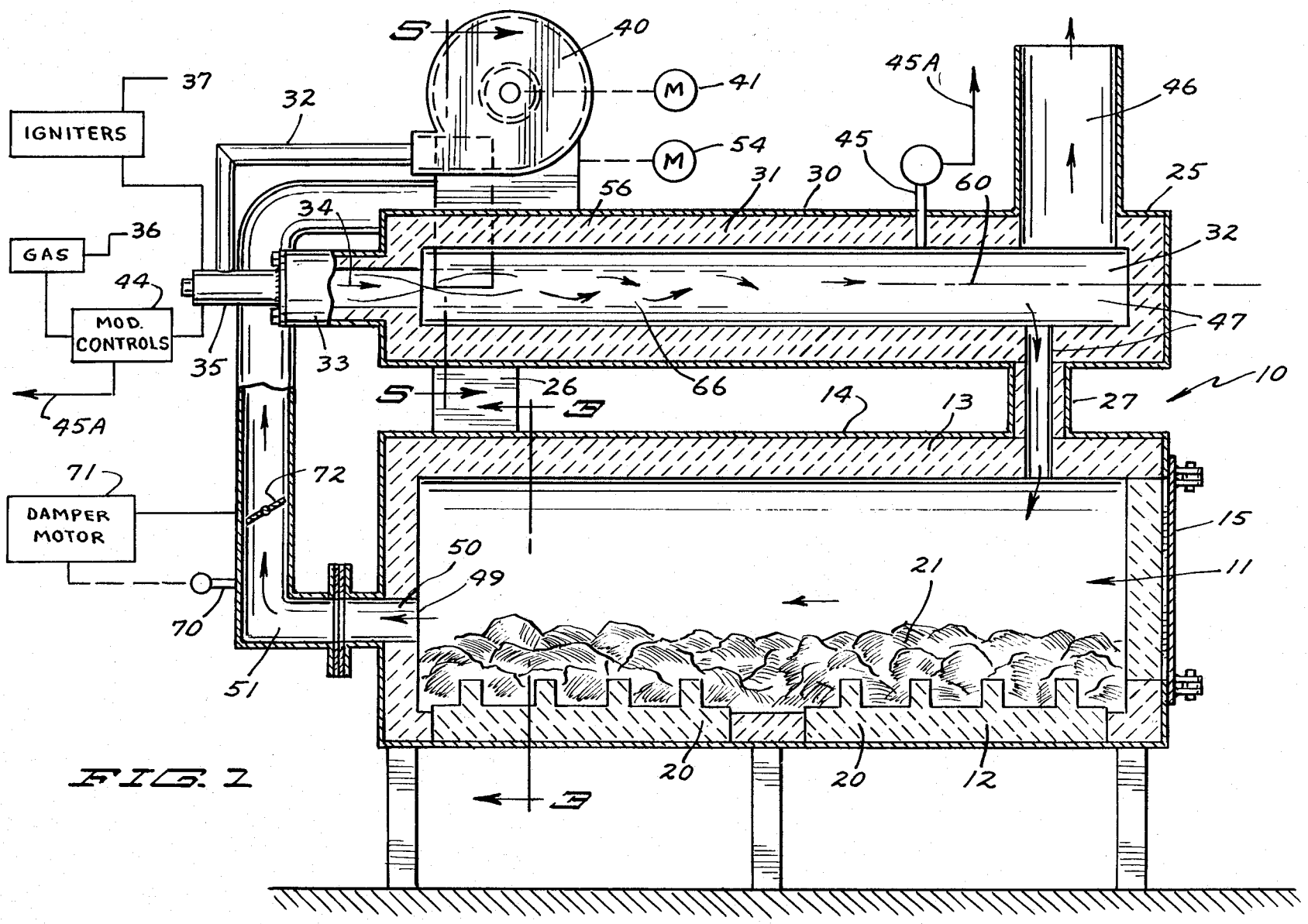
FIG. 2 is a vertical sectional view taken along line 2—2 in FIG. 1.
Figure 2:
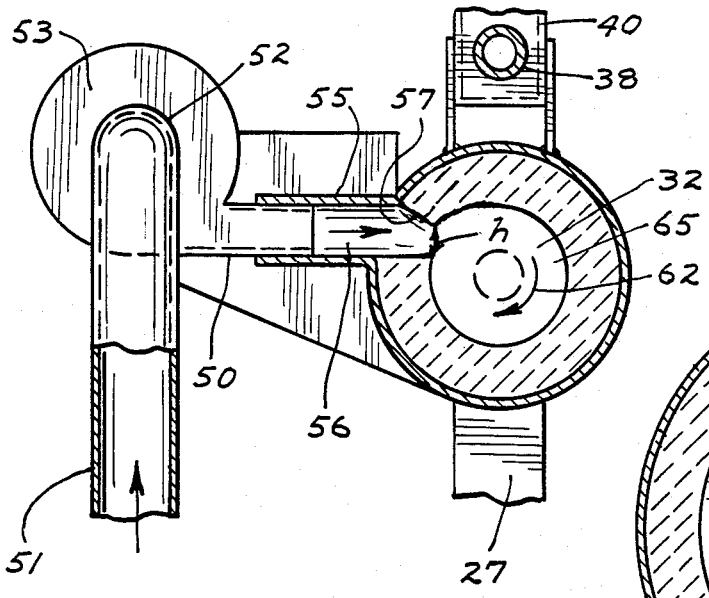

This effluent gas blower 53 is driven by a suitable motor 54. The blower is a centrifugal type blower so that the inlet is in the center of the housing, and the outlet comprises a rectangular cross section discharge pipe 54 that is connected through a connector pipe 55 forming a part of the housing 30, and through a rectangular passageway 56 defined in the pipe 53 leading into the second chamber 32. The rectangular passageway 56 has a nozzle end forming a venturi. The upper planar surface indicated at 57 of the passageway is included at a 30° angle downwardly from horizontal as shown in FIG. 2. The central axis of the passageway 56 is perpendicular to the longitudinal axis 60 of the secondary burner chamber 32. The lower surface of passageway 56 is above the longitudinal axis 60 of the chamber.

When the blower motor 54 is operating, and the blower 53 is directing air through the passageway 56, the intake port 52 of the blower is under reduced pressure and the conduit 51 therefore is tending to reduce the pressure in the chamber 11 by drawing air from the chamber through the conduit 51 into the blower. The pressure side of the blower 53 is forcing air into the chamber 32, and this creates a lower pressure in the chamber 11 than there is in the chamber 32, causing a flow of air through the passageway 47. This will cause the air coming in through the passageway 56 to move along the axis 60 of the chamber 32 at the same time it is tending to mix and rotate as indicated by the arrow 62 in FIG. 2. Because the surface 57 of the passageway 56 is inclined downwardly, it forms a venturi or nozzle that causes the particles and the gases from the lower chamber to be mixing as they discharge into chamber 32. The air moving along surface 57 cuts across the output from burner 35 and the air moving along the lower surface tends to go across the burner. There is immediate turbulation. The airflow creates an annular band of high velocity air that tends to spiral and progress from the input end of the chamber 32 to the distal or remote end in a spiral path. The dotted lines in FIG. 2 indicate a central core 65. The burner output flows within the swirling air generated by the air from the blower 53 through the passageway 56.

The air that spirals tends to mix thoroughly due to the kinetic motion of the air from the passageway 56. Then, when the burner 35 is ignited and motor 41 is started to supply air from burner blower 40 to the burner 35, and gas is supplied through the modulating controls 44, a flame will enter through the passageway 34 generally as shown by the lines 66 through this somewhat lower pressure core 65. The flame of course will be hot and will tend to burn any particles in the outer band of air and smoke coming from the blower 53 through the passageway 56.

Again, there is overall lower pressure at the distal or remote end of the chamber 32 from the burner end, and this lower pressure, coupled with a blast of air coming from the passageway 34 which is coaxial with the axis 60 of the secondary burner chamber 32, causes a flow toward the distal end and an intermixing of air and gases. Note that the passageway 34 is made to have a maximum diameter (the passageway 34 is circular in cross section) that is about half way up on the outlet of passageway 56 as shown in FIG. 1. The airflow along surface 57, as the air blows in through the passageway 56 causes an immediate turbulating action of the flame coming from the passageway 34 and the effluent gases coming from the passageway 56. The central core 65 carries gases from burner 35 and the swirling air from the passageway 56 cuts across the core and the burning gas (flame) from the burner 35. The flame will advance more rapidly in the central core area 65 where there is a reduced pressure so that the effluent gases from the passageway 56 start intermixing with the burner flame immediately. As the flame and effluent gases progress together toward the distal end of the chamber 35, there is a greater turbulation and intermixing, so that the flame starts to swirl and rotate because of the overlap of the flame passageway 34 and the passageway 56 to insure that there is a complete combustion of the effluent particles that are carried through the passageway 56 from the main burner chamber 11 into the secondary burner chamber 32.

At the remote end of chamber 32 part of the gases go through passageway 47 and part will be discharged out through the pipe 46. The gases coming through 47 will be very hot, at combustion temperature or above, as sensed and controlled by the temperature sensor and control 45. The gases entering chamber 11 through passageway 47 tend to ignite the materials 21, causing smoke to be generated, and in some instances perhaps even combustion of air depending on the temperature set at the sensor 45 (which has an adjustable set point).

The burning cycle then continues, and as the temperature in chamber 32 increases, the sensor 45 will sense this increase, and operate the modulating control 44 for the fuel supply. The sensor signal along line 45A will be received by the modulating controls 44 to adjust the gas (fuel) flow, but not the combustion air from blower 40, to maintain the temperature adjacent the distal or remote end of the chamber 32 at a desired level.

If the temperature of the effluent gases coming from the chamber 11 through opening 50 and into the conduit 51 exceed a certain set level, a second damper control temperature sensor indicated at 70 in the conduit 51 is used for closing a damper. The sensor 70 is connected for controlling a damper motor 71 that controls a normal butterfly damper 72 in the conduit 51 and regulates the flow of gases through the effluent blower 53. The damper thus also regulates the velocity of the gases and also the volume of the gases through the passageway 56.

When all of the material 21 has been burned or combusted, the temperature in conduit 51 will drop substantially, because there will no longer be any combustion or burning in the chamber 11. The sensor 70 can be set so that it will control shut down of the burner 35 as well as the blower motors 41 and 54 when the material 21 has been completed combusted. Suitable time delays and sequencing of shut down can be as desired for safety purposes.

The features of the secondary burner chamber 32 include the fact that the passageway 47 is of smaller diameter than the outlet stack or passageway 46 so that only a portion of the material or gases in the chamber 32 is recirculated into the main burning chamber 11. The outlet pipe for the effluent gases from the main burner chamber is at the input end of the second burning chamber 32. The blower outlet directing gases from chamber 11 is positioned so that its axis of flow is perpendicular to the longitudinal axis of the burner, and forms a layer of turbulent circulating air that is guided around the circular cross section of the chamber 32. The core of flame from the burner 35 will intersect at least portions of the flow of effluent gases to cause intermixing immediately and cause retarding of some of the combusting or burning flames, while permitting the central core of flames to move ahead in a type of progressive fire wall moving from the input end to the distal end of the secondary burner chamber. The burner chamber length is selected to insure substantially complete combustion of the effluent particles at the desired flow rate of effluent being used.

In practice, the diameter of the secondary chamber 32 was selected to be about 33% of the diameter of the bottom chamber. The size of the blower outlet opening will vary, depending on the speed of the blower and the width of the opening, that is, its length in direction of the longitudinal axis of the burner chamber. The velocity of the flow through passageway 34 was in the range of 70 feet per second. The diameter of inlet passageway 47 is substantially in the range of one-fourth the diameter of the outlet passageway 46.

High volume, low cost, and complete combustion of waste materials to eliminate air pollution are the objectives that are achieved with the present device. The intermixing of the effluent gases discharged through a positive discharge blower into the secondary burning chamber is caused by the swirling, vortex, or tornadic action. The intermixing or turbulation insures complete combustion.

Although the present invention has been described with reference to preferred embodiments, workers skilled in the art will recognize that changes may be made in form and detail without departing from the spirit and scope of the invention.

What is claimed is:

1. An incinerator assembly for burning organic materials comprising a first housing defining a main burning chamber having a first end and a second end;

an outlet port defined in a second end of said main burning chamber;

a second housing defining a secondary chamber, said second housing having an input end and a distal end, said secondary chamber having a substantially circular cross section and being elongated along a longitudinal central axis;

conduit means leading from the outlet port of said main burning chamber;

and effluent gas blower having an inlet connected to said conduit means, and a blower outlet opening to said secondary chamber, said blower outlet having an outlet opening central axis positioned generally perpendicular to the longitudinal axis of said secondary chamber, said blower outlet opening to the secondary chamber adjacent the input end of said secondary chamber;

a burner member mounted on said second housing and opening to the secondary chamber through an opening substantially coaxial with the longitudinal axis and opening into the secondary chamber at said input end, including burner blower means for directing burning gases generally along the central axis of said secondary chamber under burner blower pressures, said opening to the secondary chamber for said burning gases being substantially smaller than the diameter of said secondary chamber so the burning gases move along a core path adjacent the input end of the secondary chamber;

said blower outlet opening being on a lateral side of the second housing, the blower outlet opening central axis being laterally offset from the longitudinal central axis, the blower outlet opening being defined by surface means including a surface portion that is oblique with respect to the blower outlet opening central axis for directing a portion of the flow through the blower outlet opening to cross the longitudinal central axis, and intermix by moving unsymetrically across the core path with respect to the longitudinal axis;

a pipe connection at the distal end of said secondary chamber opening into said main burning chamber adjacent the first end thereof to form a circulation path when the effluent gas blower is operating; and means to control combustion rate of said burner to maintain burning in the secondary chamber and substantially completely burn combustible materials in the effluent gases as the effluent gases move along the secondary chamber from the input end to the distal end thereof.

2. The apparatus as specified in claim 1 wherein said second housing defining said secondary chamber overlies the first housing and is substantially coextensive therewith.

3. The apparatus as specified in claim 1 and temperature sensing means adjacent the distal end of said second chamber operable to control the burning of the burner of said secondary chamber.

4. The apparatus as specified in claim 1 wherein the blower outlet opening from said effluent gas blower is generally rectilinear and on a first side of the axis of the secondary chamber, the blower outlet opening being defined by a first surface which is parallel to and adjacent the longitudinal axis, and said surface portion comprises a second planar surface forming a plane intersecting the plane of the first surface in direction toward the longitudinal axis to direct effluent gases across the core portion at an angle to the central axis of the blower outlet.

5. The apparatus as specified in claim 4 and an outlet pipe leading to the atmosphere at the distal end of said secondary chamber, said outlet pipe being substantially larger than the pipe connection from the secondary chamber to the main burning chamber.

6. The apparatus as specified in claim 1 and a passageway carrying burning gases from the burner to the second chamber the end of said passageway forming the opening for burning gases, said passageway being circular in cross second and coaxial with the secondary chamber longitudinal axis.

7. The apparatus of claim 1 wherein the outlet port from said main burning chamber has a mesh covering to break up the effluent gases.

8. The apparatus as specified in claim 5 wherein the plane of the first surface of the blower outlet opening is at a level to direct flow along the first surface to intersect the core path from the burner in the secondary chamber.

9. The apparatus of claim 1 and damper means in the conduit means leading from the main burning chamber to the effluent gas blower, a temperature sensor mounted in said conduit means, said temperature sensor controlling the position of said damper means to regulate the flow of air through said conduit means as a function of temperature of the air flowing through said conduit means.

10. An incinerator for burning organic materials such as garbage comprising a first housing defining a main burning chamber having a first end and a second end;

an outlet port defined in a second end of said main burning chamber;

a second housing defining a secondary chamber, said second housing having an input end and a distal end, said secondary chamber having a substantially circular cross section and being elongated along a longitudinal central axis;

conduit means leading from the outlet port of said main burning chamber;

an effluent gas blower having an inlet connected to said conduit means, and a blower outlet opening to said secondary chamber, said blower outlet having a blower outlet central axis defining a flow axis for outlet air from said effluent gas blower positioned generally perpendicular to the longitudinal axis of said secondary chamber, said blower outlet being positioned adjacent the input end of said secondary chamber;

a burner member mounted on said second housing and opening to the secondary chamber through a passageway substantially coaxial with the longitudinal axis and opening into the secondary chamber at said input end, including blower means for directing burning gases generally in a core path along and surrounding the central axis of said secondary chamber, said opening to the secondary chamber for said burning gases being substantially smaller than the diameter of said secondary chamber;

the blower outlet comprising a rectilinear passageway having an outlet end portion defined by a first surface parallel to the longitudinal axis of the secondary chamber and defining a plane that passes through the core path of burning gases from the burner outlet, and a second planar surface oblique to the first surface and positioned more remote from the longitudinal axis than the first surface so the outlet end portion of the rectilinear passageway defines a port offset to one side of the longitudinal axis, the second surface defining a plane extending from the port toward the first plane and the longitudinal axis to induce substantial turbulence and intermixing of the effluent gases and the gases from the burner adjacent the input end of the secondary chamber;

a first pipe connected to the distal end of said secondary chamber and opening into said main burning chamber adjacent the first end thereof to form a circulation path when the effluent gas blower is operating;

a second outlet pipe leading to the atmosphere at the distal end of said secondary chamber, said second outlet pipe being substantially larger in cross section than the first pipe;

means in the conduit means leading from the main burning chamber to the effluent gas blower;

a temperature sensor mounted in said conduit means, said temperature sensor controlling the position of said damper means to regulate the flow of air through said conduit means as a function of temperature thereof; and means to control combustion of said burner to maintain a burning condition in the secondary chamber as the effluent gases circulate around the secondary chamber and travel from the input end to the distal end thereof.

* * * * *